US011556094B2

(12) United States Patent
Noiberg et al.

(10) Patent No.: US 11,556,094 B2
(45) Date of Patent: Jan. 17, 2023

(54) FLUID TIMER

(71) Applicants: Idan Noiberg, Herzliya (IL); Liran Blum, Moshav Bnaya (IL)

(72) Inventors: Idan Noiberg, Herzliya (IL); Liran Blum, Moshav Bnaya (IL)

( * ) Notice: Subject to any disclaimer, the term of this patent is extended or adjusted under 35 U.S.C. 154(b) by 958 days.

(21) Appl. No.: 16/375,376

(22) Filed: Apr. 4, 2019

(65) Prior Publication Data

US 2019/0310586 A1 Oct. 10, 2019

(30) Foreign Application Priority Data

Apr. 9, 2018 (IL) ..... 258559

(51) Int. Cl.
*G04F 1/06* (2006.01)
*B65D 41/04* (2006.01)

(52) U.S. Cl.
CPC ..... *G04F 1/06* (2013.01); *B65D 41/04* (2013.01)

(58) Field of Classification Search
CPC ..... G04F 1/00; G04F 1/04; G04F 1/06
See application file for complete search history.

(56) References Cited

U.S. PATENT DOCUMENTS 4,054,026 A * 10/1977 Goodrich ..... G04F 1/08 968/808
4,117,666 A * 10/1978 Aguilar ..... G04F 1/06 368/91
4,408,894 A * 10/1983 Hemperly ..... G04F 1/06 368/95
5,117,405 A * 5/1992 Thibault ..... G04F 1/06 368/93
5,924,294 A * 7/1999 Tiby ..... G01K 11/06 374/E11.006
2009/0219789 A1* 9/2009 Meadows ..... G04B 19/00 368/223
2015/0098665 A1 4/2015 Vouillamoz

FOREIGN PATENT DOCUMENTS

| | | | |
|---|---|---|---|
| CN | 201788367 | U | 4/2011 |
| CN | 104192394 | A | 12/2014 |
| DE | 29710177 | U1 | 12/1997 |
| JP | S50123661 | U | 10/1975 |
| JP | S55158856 | A | 12/1980 |
| JP | S5771073 | U | 4/1982 |
| JP | H10282266 | A | 10/1998 |

OTHER PUBLICATIONS

Machine Translation of DE19825473 (Year: 2022).*

* cited by examiner

*Primary Examiner* — Edwin A. Leon
*Assistant Examiner* — Jason M Collins
(74) *Attorney, Agent, or Firm* — Fresh IP PLC; Clifford D. Hyra; Aubrey Y. Chen

(57) ABSTRACT

A fluid timer configured to receive fluid therein when the timer is in a first orientation and to emit fluid along a timer vertical axis during pre-determined time when the timer is in a second, reversed orientation.

17 Claims, 6 Drawing Sheets

FLUID TIMER

TECHNOLOGICAL FIELD

The presently disclosed subject matter relates to fluid timers.

BACKGROUND

More particularly, the presently disclosed subject matter relates to a fluid timer, a bottle cap with a fluid timer, and a bottle having such cap, and examples of at least some of these are disclosed in CN201788367, JPS55158856, JPS5771073, US2015098665, JPS50123661, CN104192394, and JPH10282266.

Acknowledgement of the above references herein is not to be inferred as meaning that these are in any way relevant to the patentability of the presently disclosed subject matter.

GENERAL DESCRIPTION

According to one aspect of the presently disclosed subject matter, there is provided a fluid timer configured to receive fluid therein when the timer is in a first orientation and to emit fluid along a timer vertical axis during pre-determined time when the timer is in a second, reversed orientation, the timer comprising:

an outer vessel having an outer vessel interior extending between its top and bottom along said axis, being configured for holding fluid within the outer vessel interior in the first orientation of the timer; and an inner vessel at least partially disposed within and surrounded by the outer vessel interior, the inner vessel having an inner vessel interior extending between its top and bottom along said axis, the inner vessel being formed with one or more ingress ports closer to its bottom than to its top, by means of which the outer and inner vessels are configured to function as communicating vessels to allow filling of the inner vessel with fluid, in the first orientation of the timer, by allowing fluid from the outer vessel to enter the inner vessel through said ingress ports; the inner vessel being further formed with at least one egress port configured to allow the fluid to be emitted therethrough from the inner vessel interior during said pre-determined time when the timer is in the second orientation.

The fluid can be in the form of liquid, which is configured to be emitted through the egress port by virtue of gravity, or in the form of gas which is configured to be emitted through the egress port by virtue of buoyancy. In the former case, the at least one egress port has an area smaller or equal to the total area of the ingress ports. In the latter case, the arrangement is opposite.

The outer vessel can have an open region, through which fluid can be poured into the outer vessel interior to allow filling of the inner vessel with fluid, wherein its area is greater than the area of the egress ports.

With the above structure of the timer, its use can include at least a first step in which the timer is in the first orientation and fluid is poured into the outer vessel interior until the inner vessel interior is filled therewith to a desired extent, and a second step, in which the timer is turned upside down into the second orientation to allow the fluid to drop out of the inner vessel interior via the egress ports. The time, which the timer is configured to measure is the total time of fluid emission from the egress ports when the timer is in its second orientation, The outer and inner vessels can be formed as a unitary body or as an assembly, which is integral at least during its use.

The inner vessel can be disposed within the interior of the outer vessel so that in the first orientation of the timer the inner vessel is disposed below the outer vessel top and above the outer vessel bottom, and in the second orientation of the timer, the inner vessel is disposed above the inner vessel top and below the inner vessel bottom.

The outer vessel has an inner surface defining its interior and the inner vessel bottom can comprise bottom portions extending in a direction away from the inner vessel interior and connected to the inner surface of the outer vessel at its area adjacent the bottom so as to hold the inner vessel within the outer vessel interior, the bottom portions being spaced from each other by gaps constituting the ingress ports.

According to another aspect of the presently disclosed subject matter, the timer can be in the form of a bottle cap for use with a bottle whose throat has an outer surface with a threading, an inner surface and an end rim, wherein the outer vessel has threading on its inner surface defining the outer vessel interior, the threading corresponding to that on the bottle throat. In this case the timer can be configured to be mounted on the bottle throat so that its outer vessel surrounds the throat with their threadings engaging each other, the outer vessel bottom covers the throat, and the inner vessel is disposed within the throat. With such arrangement, when the bottle containing fluid is oriented with its throat facing downwardly, the timer cap mounted on its throat is in the first orientation and fluid from the bottle can be used to fill the inner vessel, whilst when the bottle is brought into its normal orientation with its throat facing upwardly, the timer in its second orientation, whether left on the bottle's throat or removed therefrom, produces drops emitted through the egress ports of the inner vessel.

According to a further aspect of the presently disclosed subject matter, there is provided a bottle with a cap as defined above.

The top of the interior of the inner vessel can have a minimal cross-sectional dimension which is smaller than that of the bottom of the inner vessel so as to create higher head of fluid therein when the timer is in its second orientation.

The outer vessel can be at least partially transparent.

The inner vessel can include any form of indicia for indicating time corresponding to the amount of fluid therein.

The indicia can be in the form of a transparent window through which the fluid within the inner vessel is visible.

The outer and inner vessels in any of the above aspects can have any desired configuration. For example, any one or each of them can be telescopic. They can also be made of a solid or elastic material, the latter allowing the vessels to change their shape. The vessels can also be made of different materials.

In any of the above aspects, the timer can be produced as a unitary body or as an assembly of two separately produced vessels fixed to each other. Alternatively, the timer can be produced only partially as a unitary body and can have at least one complementary component assembled therewith to allow its functionality. For example, the timer can comprise an opening at the bottom of the outer vessel, having a configuration corresponding to that of the bottom of the inner vessel, allowing molding of the two vessels together as a unitary body, and a cover configured to be securely and sealingly received within the opening to fully close it.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
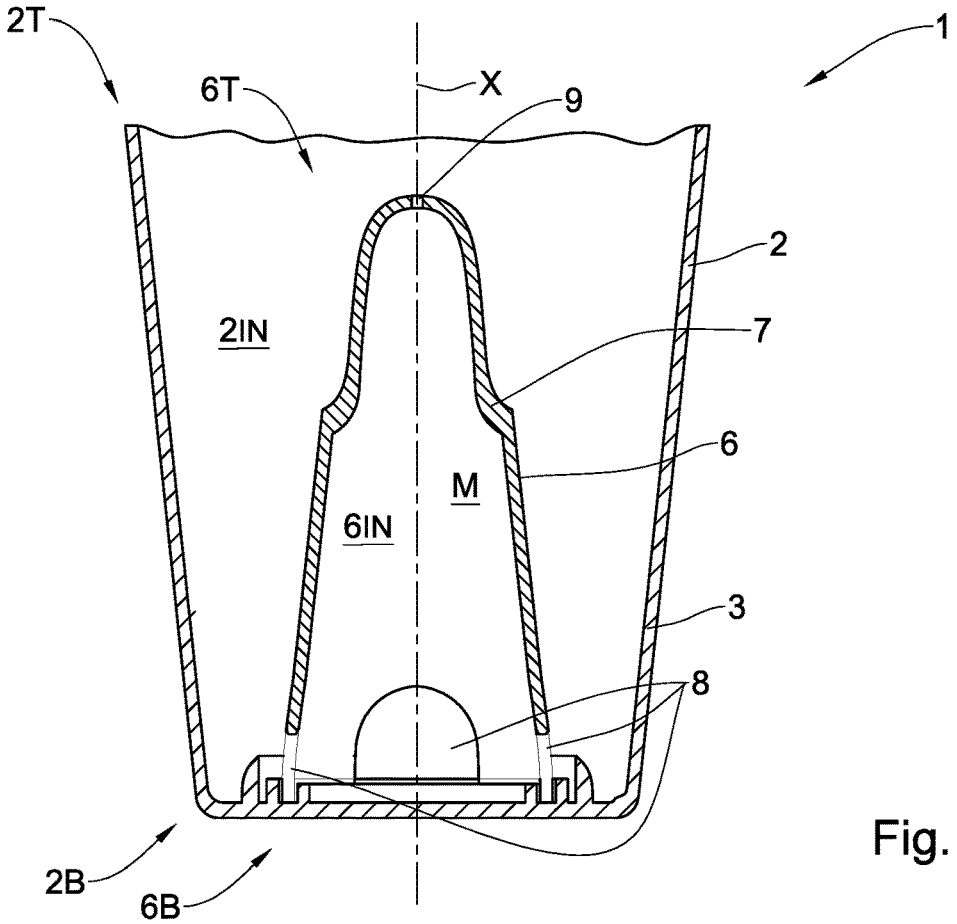
FIG. 1 is a schematic view of a fluid timer according to one example of the presently disclosed subject matter.
Figure 2A:
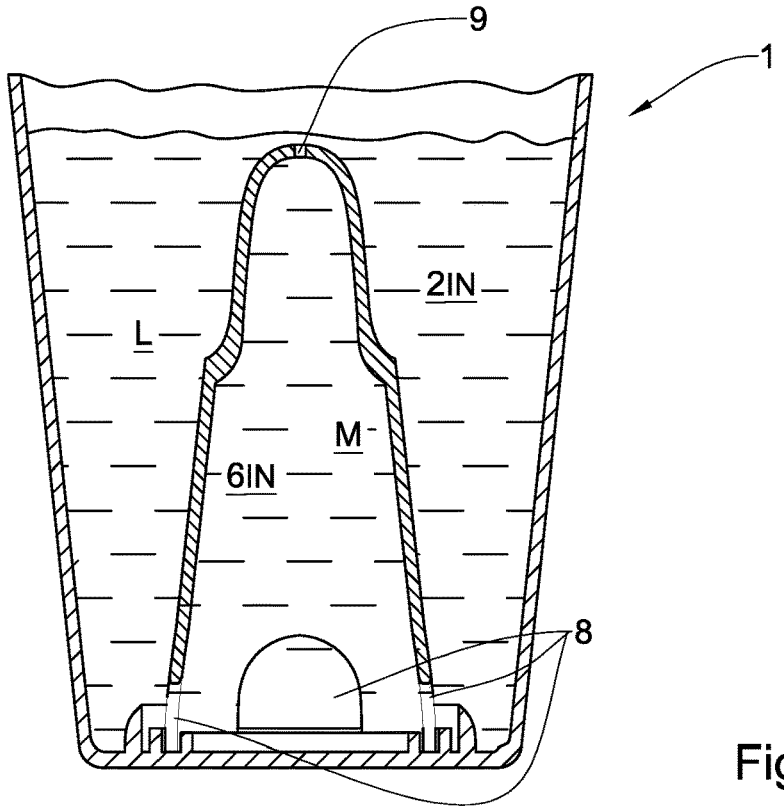
FIG. 2A is a schematic view of the fluid timer shown in FIG. 1, when in operation in its first orientation.
Figure 2B:
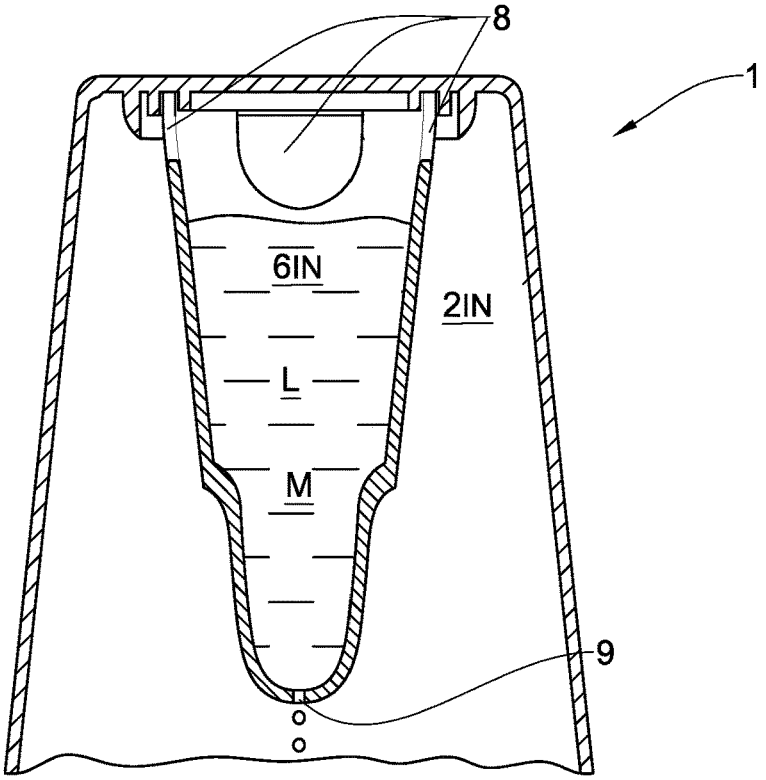
FIG. 2B is a schematic view of the fluid timer shown in FIGS. 1 and 2, in operation in its second orientation.

FIG. 1 illustrates a liquid timer 1 according to one example of the presently disclosed subject matter, which is configured to function in two opposite orientations illustrated in FIGS. 2A and 2B.

The liquid timer 1 consists of an outer vessel 2 having a cup-like shape and an inner vessel 6 having an inverted cup-like shape and disposed within the outer vessel 2.

The timer 1 is configured to receive a liquid L at a first orientation of the timer illustrated in FIG. 2A, and to emit the liquid L by virtue of gravity along a timer vertical axis X during pre-determined time, in its second, inverted orientation illustrated in FIG. 2B.

Each of the vessels has a top area 2T, 6T, a bottom area 2B, 6B, and an interior 2IN, 6IN extending therebetween along the vertical axis X of the timer. The areas 2T, 2B and 6T, 6B are defined for the timer being in the first orientation as seen in FIGS. 1 and 2A. The interior 2IN, 6IN of each of the vessels 2, 6 is defined by its corresponding circumferential wall 3, 7.

All dimensions of the vessel 6 are smaller than corresponding dimensions of the vessel 2 and the vessel 6 is disposed within and surrounded by the interior 2IN of the outer vessel 2.

The circumferential wall 3 of the outer vessel 2 is impermeable to liquid, making the interior 3 suitable for holding liquid in the first orientation of the timer 1.

The vessel 6 has such a configuration and is so connected to the vessel 2 that the interior 6IN of the inner vessel 6 is in fluid communication with the interior 2IN of the outer vessel 2.

In the described example, this communication is provided via ingress ports 8 formed in the circumferential wall 7 of the inner vessel 6, thus allowing the vessels 2 and 6 to function as communicating vessels. This allows filling the inner vessel 6 with liquid L when the liquid is disposed in the interior 2IN of the outer vessel 2 in the first orientation of the timer 1, as shown in FIG. 2A, by the allowing entering of the liquid L to the inner vessel 6 through the ingress ports 8.

The inner vessel 6 is further formed with an egress port 9 configured to emit therethrough the liquid L from the interior 6IN of the inner vessel 6 during the pre-determined time when the timer 1 is in its second orientation, as illustrated in FIG. 2B.

In the described example, the egress port 9 is positioned at the top area 6T of the inner vessel 6, whilst the ingress ports 8 are all positioned at the bottom area 6B of the inner vessel, defining therebetween a measurement area M of the interior 6IN of the inner vessel 6.

This measurement area M can be filled with liquid coming therein through the ingress ports 8 when the outer vessel 2 is filled with liquid, when the timer 1 being in its first orientation, and be emptied through the egress port 9 when the timer 1 is in its second orientation.

The measurement area M can have a conical shape, for creating higher head above the egress port 9 for a given volume of liquid L therewithin, when the timer 1 is in the second orientation.

The area of the egress port 9 is substantially smaller than the total area of the ingress ports 8, causing the filling time of the measurement area M to be substantially shorter than the emptying time thereof, so that when the timer 1 is turned from its first orientation to its second orientation, some of the liquid L becomes temporarily trapped in the measurement area M between the ingress ports 8 and the egress port 9.

The size and shape of the egress port 9 and the size and configuration of the measurement area M can thus be configured so that this trapped liquid can drip through the port until the measurement area M is emptied.

The duration of this dripping and thus the pre-determined maximal time, which the timer 1 is configured to measure, will depend on the volume of the measurement area M, the area of the egress port 9, the kind of liquid and the original amount of liquid within the measurement area M. The maximal duration can be achieved when the entire measurement area M is filled with the liquid in the first orientation of the timer.

In the present example, the inner vessel 6 has four ingress ports 8 and one egress port 9, though these numbers can vary, provided that the total area of the ingress ports 8 is at least not less than the total area of the egress port 9.

In operation, the timer 1 is initially held in its first orientation shown in FIG. 2A, so that when the liquid L is poured into the interior 2IN of the outer vessel 2, it eventually enters through ingress ports 8 into the interior 6IN of the inner vessel 6, to fill the measurement area M to a desired extent. Once the measurement area M is completely full, the timer 1 is turned into its second orientation shown in FIG. 2B. In the turning process, all the liquid which is disposed outside the measurement area M is being emitted out of the timer 1 at once, and the remaining liquid L is trapped in the measurement area M.

In its second orientation, the timer 1 emits the remaining liquid from the measurement area M through the egress port 9 during the time corresponding to the amount of liquid trapped therein.

When the outer and inner vessels of the timer are non-transparent, the timer can be used to measure only the time corresponding to the maximal amount of liquid that can be trapped in the measurement area M of the inner vessel 6. However, when the circumferential walls 3 and 7 are transparent or at least have transparent windows such that the level of liquid within the measurement area M can be visible to an observer holding the timer 1 in its second orientation, the timer can be used to measure shorter time than the maximal time corresponding to the maximal amount of liquid that can be trapped in the measurement area M.

The timer 1 can further have indicia for indicating different time intervals corresponding to different liquid levels in the measurement area M. Such indicia can be provided on the circumferential wall 7 of the inner vessel 6 and/or circumference wall 3 of the outer vessel 2.

It should be understood that in general, the timer 1 can allow measuring time based on the egress of air bubbles from the interior 6IN of the inner vessel 6 via the egress port 9, during filling of the measurement area M with the liquid L, when the timer is in its first orientation until the liquid level in the vessels 2 and 6 of the timer 1 reaches the level of the egress port 9.

Figure 3A:
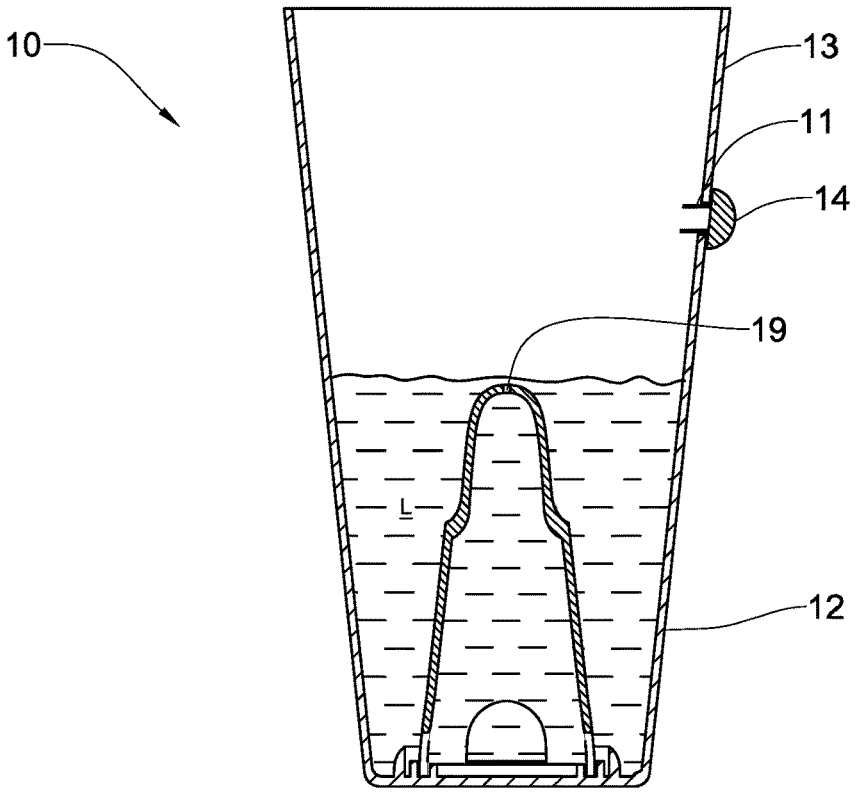
FIG. 3A is a schematic sectional view of a fluid timer of the kind shown in FIGS. 1 to 2B, incorporated in a closed time-measuring device in accordance with another example of the presently disclosed subject matter, when in operation in its first orientation.
Figure 3C:
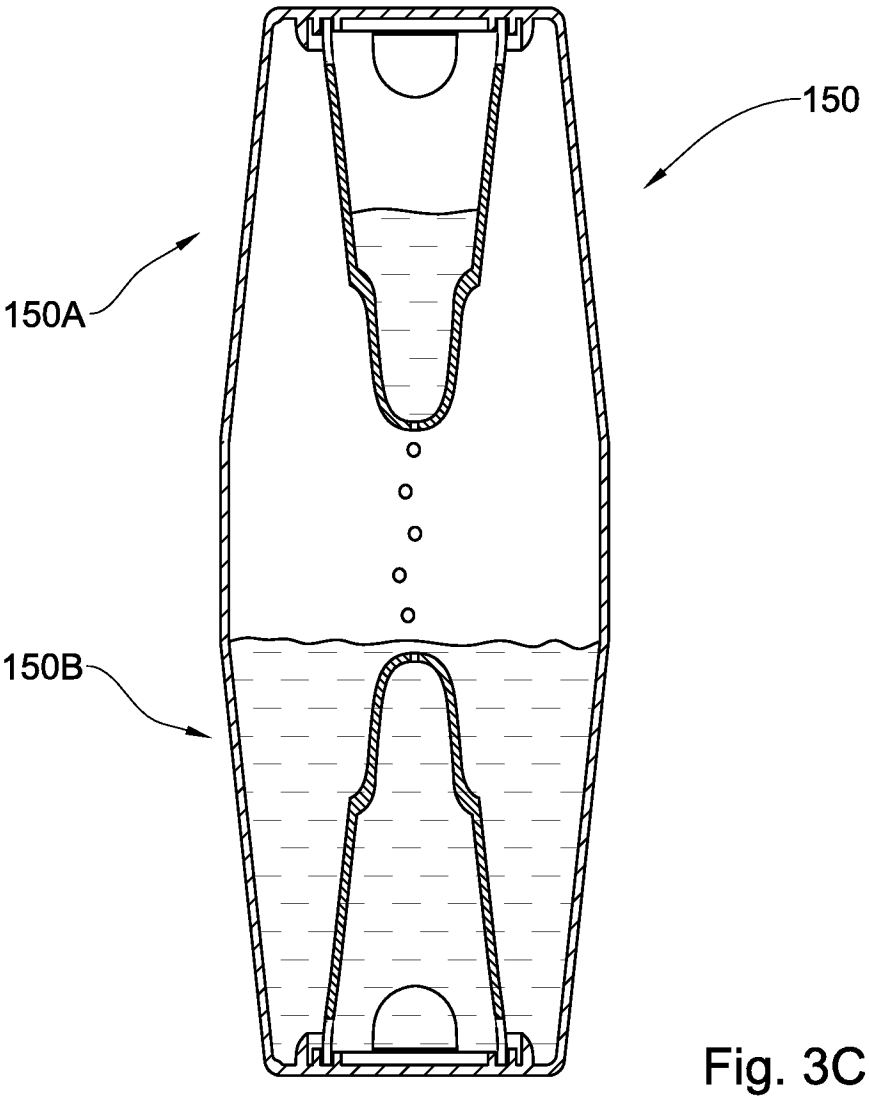
FIG. 3C is a schematic view of two fluid timers of FIG. 3A, oppositely connected to each other.
Figure 3B:
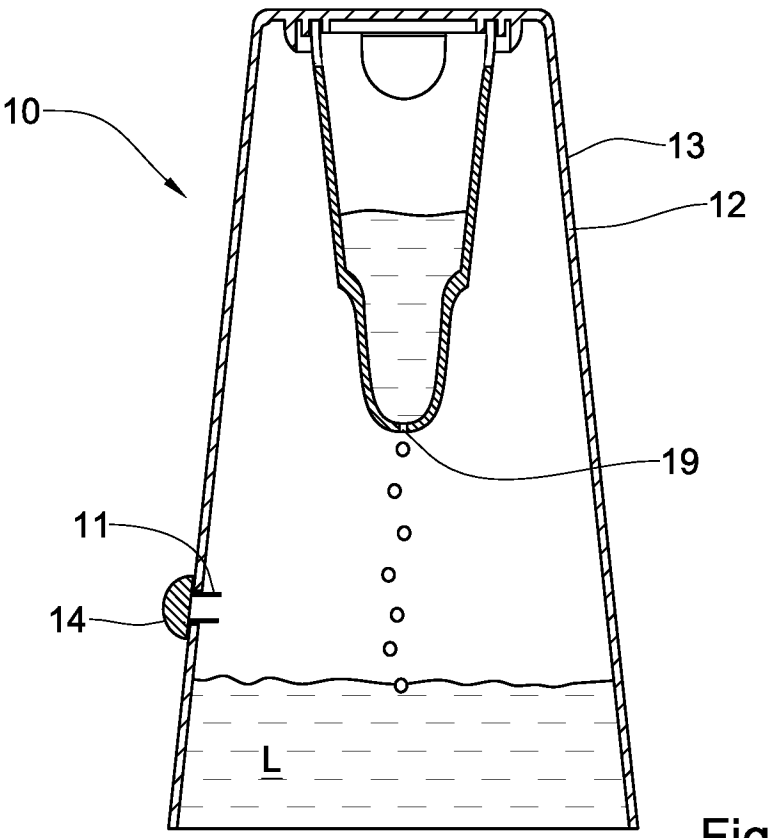
FIG. 3B is a schematic view of the fluid timer shown in FIG. 3A, when in operation in its second orientation.

A timer similar to the timer 1 can be in the form of a closed device, for example, a closed timer 10 shown in FIGS. 3A and 3B, having a constant amount of liquid L stored therewithin.

The relation between the amount of liquid L in the time-measuring device 10 and the inner volume thereof which can receive the liquid L, can be such that when the device 10 is in its first orientation, as seen in FIG. 3A, the level of liquid L within an outer vessel 12 of the time measuring device 10 is higher than the level of the egress port 19, and when the device 10 is in its second orientation, as seen in FIG. 3B, the level of liquid L within the outer vessel of the time measuring device 10 is constantly below the level of the egress port 19.

The time measuring device can be formed with a sealable opening allowing to introduce liquid therein, the opening being disposed higher than the level up to which it is planned to fill the outer vessel 12 with liquid in the manufacturing process of the device so as to be sealed after the entry of the desired amount of liquid. In the time measuring device 10, this opening is designated as 11 and it is formed in a circumferential wall 13 of the outer vessel 12, and is configured to be sealed by a seal 14.

Another example of a closed timer is shown in FIG. 3C, where a timer 150 is double-sided, having two identical portions 150A and 150B comprising a timer similar to the timer 1 shown in FIGS. 1 to 2B, where each portion 150A,150B faces the other portion and positioned oppositely thereto.

the amount of liquid L within the time-measuring device 150 can be such that at either positioning of the time-measuring device 150, the level of liquid L exceeds the level of the bottom egress port 9 of the bottom timer, so that the time-measuring device 150 will always be ready for action.

Figure 4A:
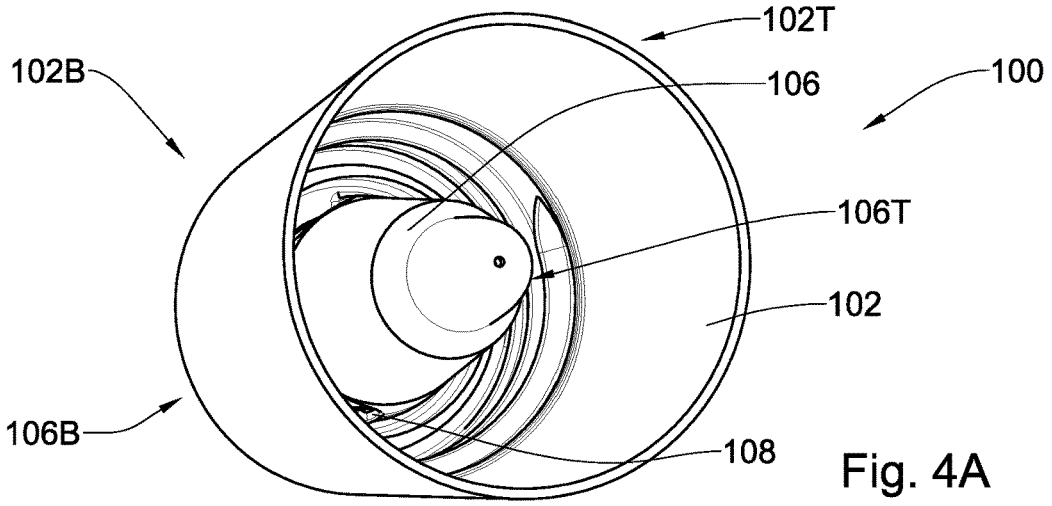
FIG. 4A is a schematic view of a fluid timer incorporated in a bottle cap according to a further example of the presently disclosed subject matter.
Figure 4B:
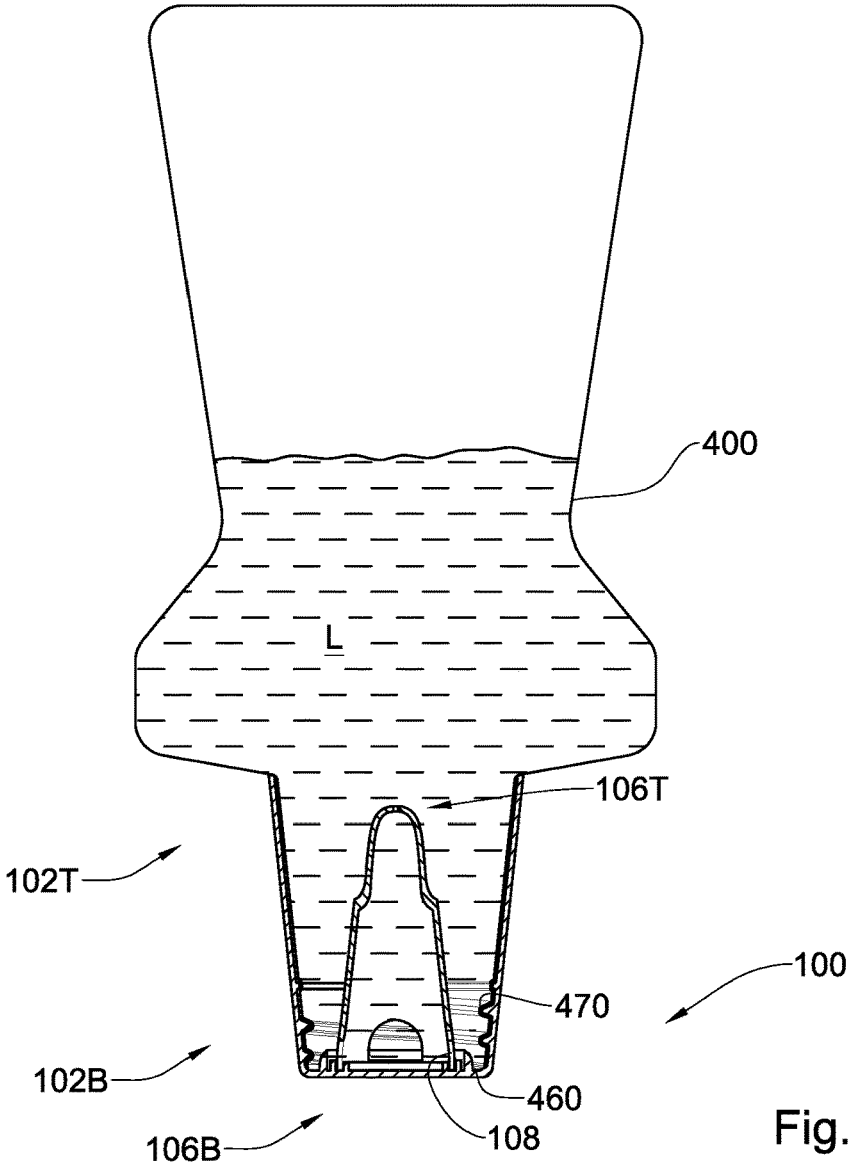
FIG. 4B is a schematic view of the fluid timer shown in FIG. 4A, when in operation in its first orientation.
Figure 4C:
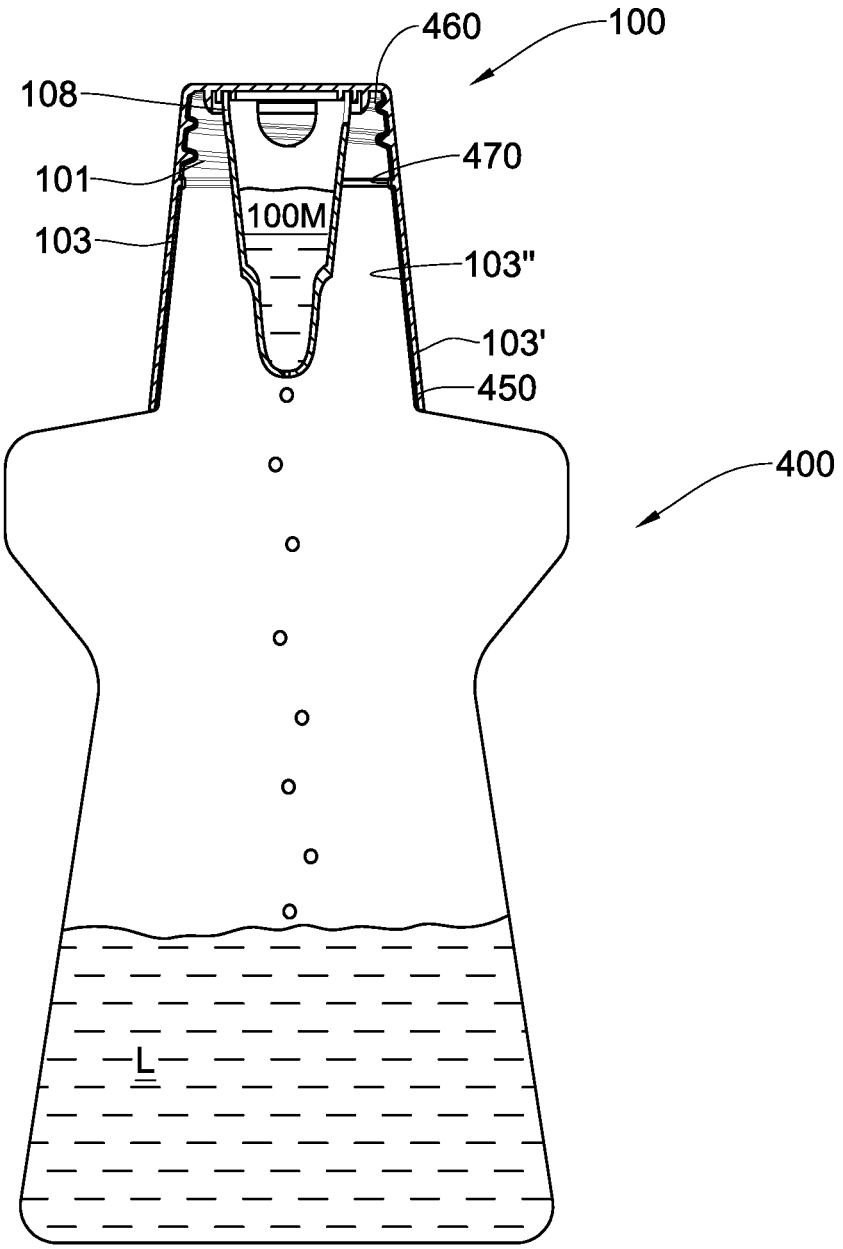
FIG. 4C is a schematic view of the fluid timer shown in FIGS. 4A and 4B, when in operation in its second orientation.

A timer similar to the timer 1 can be in the form of a bottle cap, such as a bottle cap timer 100 illustrated in FIGS. 4A to 4C, being mounted to a bottle neck 450 of a bottle 400 containing liquid L, the bottle neck 450 having an open end 460 and an outer surface formed with a threading 470 adjacent the open end.

The bottle cap timer 100 has an outer vessel 102 with a top 102T and bottom 102B, an inner vessel 106 with a top 106T and a bottom 106B having ingress ports 108, a circumferential wall 103 of the outer vessel with an outer surface 103' configured for being conveniently grasped by a user and an inner surface 103" formed with a threading 101 engageable with the threaded top 470 of the bottle neck 450.

Thus, when the bottle cup timer 100 in its second orientation is mounted to the open end 460 of the bottle 400 in its normal orientation, with their threadings engaging each other, the outer vessel 102 of the timer surrounds the bottle neck 450, the outer vessel bottom 102B of the timer covers the open end 460, the inner vessel 106 of the timer is disposed within the bottle neck 450, and the inner vessel top 106T faces towards an interior of the bottle 400.

With such arrangement, in order for the liquid L contained in the bottle 400 to be introduced into the timer 100, the bottle can be turned over, thereby bringing the timer 100 mounted thereon into the first orientation. Once the liquid L from the bottle 400 fills to a desired extent the outer and inner vessels 102 and 106 of the timer, which communicate through the ingress ports 108, the bottle can be turned over again into its normal orientation with its threaded top 470 facing upwardly, thus bringing the timer 100 into its second orientation and causing the liquid L to be trapped in the measurement area 100M thereof and thereafter to start dripping out therefrom through the egress port 109.

Figure 5B:
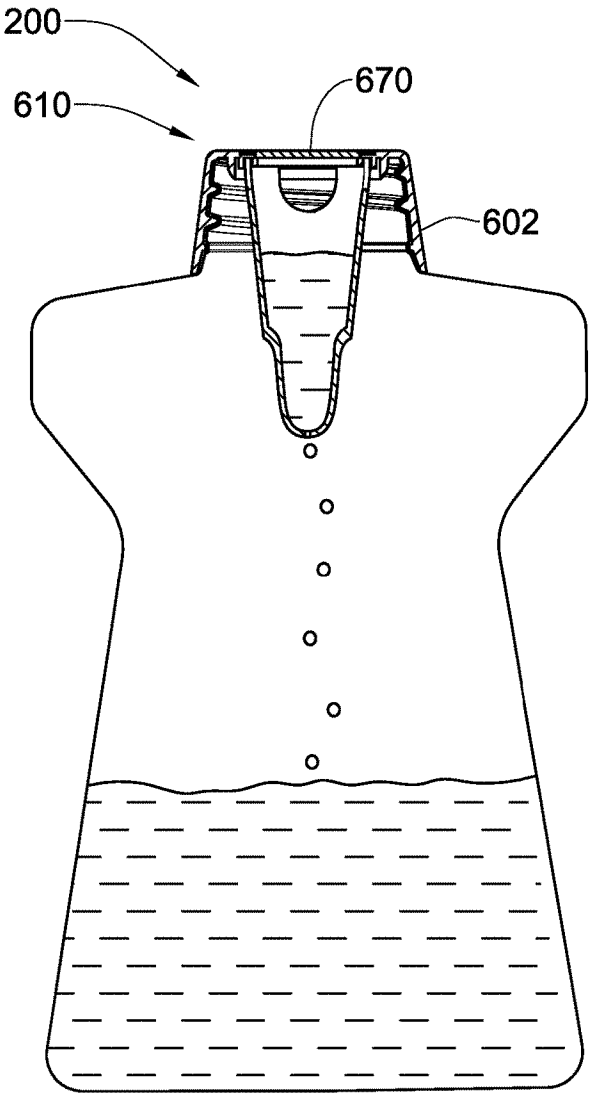
FIG. 5A is a schematic view of a fluid timer incorporated in a bottle cap according to still a further example of the presently disclosed subject matter, in its first orientation; and, FIG. 5B is a schematic view of the fluid timer shown in FIG. 5A in its second orientation.
Figure 5A:
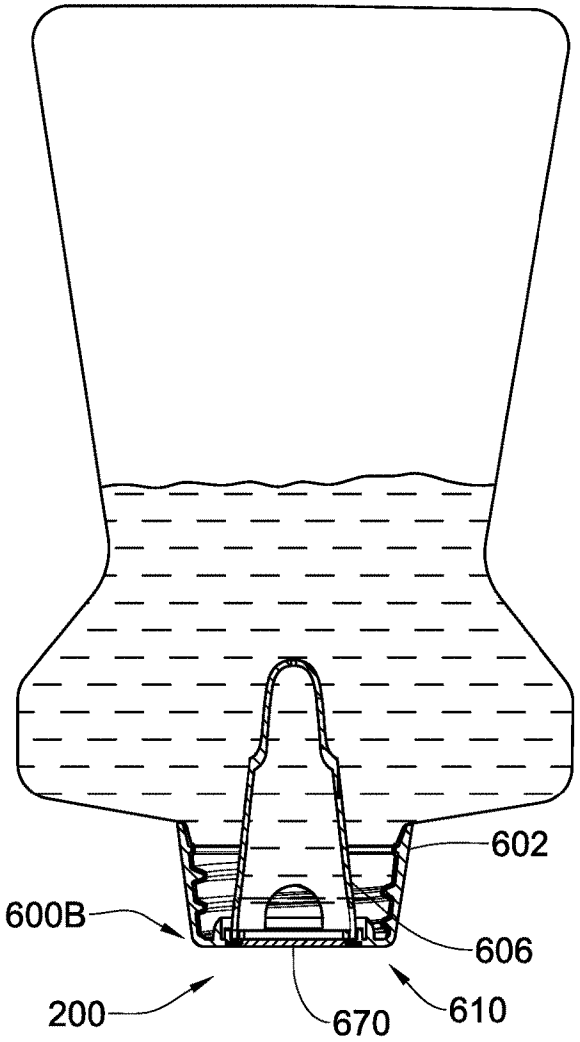

FIGS. 5A and 5B illustrate another example of a bottle cap timer 200 in its first and second orientations respectively, which differs from the timer 100 in that its outer vessel is shorter than the inner vessel so that the inner vessel's top 206T protrudes outwardly from the outer vessel's top 202T.

In any of the above examples of the presently disclosed subject matter, the timer can be produced with a relatively large opening at its bottom sealingly covered by its outer vessel In any of the above examples of the presently disclosed subject matter, the outer and inner vessels can be formed as a single unitary body. Alternatively, they can be assembled from two separate vessels, e.g. by means of a snap arrangement at the bottom areas thereof to operate as an integral unit at least during the use of the timer. Another option is producing the two vessels as a unitary body with an open bottom of the outer vessel and sealingly closing the bottom with a corresponding cover securely fixed therein.

One example of a timer according to the latter of the above options is illustrated in FIGS. 5A and 5B. As seen in FIG. 5A, a timer designated as 200 has an outer vessel 602 and an inner vessel 606 produced as an unitary body 610 with a bottom 600B of the outer vessel 602 having an opening of a configuration corresponding to that of a bottom of the inner vessel (not seen), and a separate cover 670 configured to be securely and sealingly received within the opening, e.g. by snap locking, to fully close it as shown in FIG. 5B. This configuration can be particularly advantageous for producing the unitary body 610 by injection molding.

The invention claimed is:

1. A fluid timer configured to receive fluid therein when the fluid timer is in a first orientation and to emit fluid along a timer vertical axis during a pre-determined time when the fluid timer is in a second, reversed orientation, the fluid timer comprising:

an outer vessel having an outer vessel interior extending between a top thereof and a bottom thereof along said timer vertical axis, being configured for holding fluid within the outer vessel interior in the first orientation of the fluid timer; and an inner vessel at least partially disposed within and surrounded by the outer vessel interior, the inner vessel having an inner vessel interior extending between a top thereof and a bottom thereof along said timer vertical axis, the inner vessel being formed with one or more ingress ports closer to the bottom than to the top, by means of which the outer and inner vessels are configured to function as communicating vessels to allow filling of the inner vessel with fluid, in the first orientation of the fluid timer, by allowing fluid from the outer vessel to enter the inner vessel through said ingress ports; the inner vessel being further formed with at least one egress port configured to allow the fluid to be emitted therethrough from the inner vessel interior during said pre-determined time when the fluid timer is in the second, reversed orientation, wherein the top of the interior of the inner vessel has a minimal cross-sectional dimension, which is smaller than that of the bottom of the inner vessel so as to create a higher head of fluid therein when the fluid timer is in the second, reversed orientation.

2. The fluid timer according to claim 1, wherein the fluid is in the form of liquid.

3. The fluid timer according to claim 2, wherein said at least one egress port has an area smaller or equal to a total area of the one or more ingress ports.

4. The fluid timer according to claim 1, wherein said outer vessel has an open region, through which fluid can be poured into the outer vessel interior to allow the filling of the inner vessel with fluid.

5. The fluid timer according to claim 4, wherein said open region has an area greater than an area of the one or more egress ports.

6. The fluid timer according to claim 1, wherein said inner vessel is disposed within the interior of the outer vessel so that in the first orientation of the fluid timer the inner vessel is disposed below the outer vessel top and above the outer vessel bottom, and in the second, reversed orientation of the fluid timer, the inner vessel is disposed above the outer vessel top and below the outer vessel bottom.

7. The fluid timer according to claim 1, wherein said outer vessel is at least partially transparent.

8. The fluid timer according to claim 1, wherein said inner vessel includes an indicia for indicating time corresponding to an amount of fluid therein.

9. The fluid timer according to claim 8, wherein said indicia is in the form of a transparent window through which the fluid within the inner vessel is visible.

10. The fluid timer according to claim 1, wherein the fluid timer is in the form of an assembly of two separately produced vessels fixed to each other.

11. The fluid timer according to claim 1, operable by a method comprising:

positioning the fluid timer in the first orientation and pouring fluid into the outer vessel interior until the inner vessel interior is filled with the fluid to a desired extent; and turning the fluid timer upside down into the second, reversed orientation to allow the fluid to drop out of the inner vessel interior via the one or more egress ports.

12. A fluid timer configured to receive fluid therein when the fluid timer is in a first orientation and to emit fluid along a timer vertical axis during a pre-determined time when the fluid timer is in a second, reversed orientation, the fluid timer comprising:

an outer vessel having an outer vessel interior extending between a top thereof and a bottom thereof along said timer vertical axis, being configured for holding fluid within the outer vessel interior in the first orientation of the fluid timer; and an inner vessel at least partially disposed within and surrounded by the outer vessel interior, the inner vessel having an inner vessel interior extending between a top thereof and a bottom thereof along said timer vertical axis, the inner vessel being formed with one or more ingress ports closer to the bottom than to the top, by means of which the outer and inner vessels are configured to function as communicating vessels to allow filling of the inner vessel with fluid, in the first orientation of the fluid timer, by allowing fluid from the outer vessel to enter the inner vessel through said ingress ports; the inner vessel being further formed with at least one egress port configured to allow the fluid to be emitted therethrough from the inner vessel interior during said pre-determined time when the fluid timer is in the second, reversed orientation, wherein said outer vessel has an inner surface defining an interior thereof and the inner vessel bottom comprises bottom portions extending in a direction away from the inner vessel interior and connected to the inner surface of the outer vessel at an area thereof adjacent to the bottom so as to hold the inner vessel within the outer vessel interior, the bottom portions being spaced from each other by gaps constituting the ingress ports.

13. A fluid timer configured to receive fluid therein when the fluid timer is in a first orientation and to emit fluid along a timer vertical axis during a pre-determined time when the fluid timer is in a second, reversed orientation, the fluid timer comprising:

an outer vessel having an outer vessel interior extending between a top thereof and a bottom thereof along said timer vertical axis, being configured for holding fluid within the outer vessel interior in the first orientation of the fluid timer; and an inner vessel at least partially disposed within and surrounded by the outer vessel interior, the inner vessel having an inner vessel interior extending between a top thereof and a bottom thereof along said timer vertical axis, the inner vessel being formed with one or more ingress ports closer to the bottom than to the top, by means of which the outer and inner vessels are configured to function as communicating vessels to allow filling of the inner vessel with fluid, in the first orientation of the fluid timer, by allowing fluid from the outer vessel to enter the inner vessel through said ingress ports; the inner vessel being further formed with at least one egress port configured to allow the fluid to be emitted therethrough from the inner vessel interior during said pre-determined time when the fluid timer is in the second, reversed orientation, wherein at least the outer and inner vessels together are in the form of a unitary body, wherein the fluid timer further comprises at least one complementary component assembled with the unitary body to allow a functionality thereof, and wherein the outer vessel is formed with an opening at the outer vessel bottom, the opening having a configuration corresponding to that of the bottom of the inner vessel, and a cover configured to be securely and sealingly received within the opening to fully close the opening.

14. A fluid timer configured to receive fluid therein when the fluid timer is in a first orientation and to emit fluid along a timer vertical axis during a pre-determined time when the fluid timer is in a second, reversed orientation, the fluid timer comprising:

an outer vessel having an outer vessel interior extending between a top thereof and a bottom thereof along said timer vertical axis, being configured for holding fluid within the outer vessel interior in the first orientation of the fluid timer; and an inner vessel at least partially disposed within and surrounded by the outer vessel interior, the inner vessel having an inner vessel interior extending between a top thereof and a bottom thereof along said timer vertical axis, the inner vessel being formed with one or more ingress ports closer to the bottom than to the top, by means of which the outer and inner vessels are configured to function as communicating vessels to allow filling of the inner vessel with fluid, in the first orientation of the fluid timer, by allowing fluid from the outer vessel to enter the inner vessel through said ingress ports; the inner vessel being further formed with at least one egress port configured to allow the fluid to be emitted therethrough from the inner vessel interior during said pre-determined time when the fluid timer is in the second, reversed orientation, wherein said fluid timer is in the form of a bottle cap for use with a bottle.

15. A bottle cap for use with a bottle having a throat including an outer surface with a threading, an inner surface and an end rim, the bottle cap being in the form of the fluid timer configured to receive fluid therein when the fluid timer is in a first orientation and to emit fluid along a timer vertical axis during a pre-determined time when the fluid timer is in a second, reversed orientation, the fluid timer comprising:

an outer vessel having an outer vessel interior extending between a top thereof and a bottom thereof along said timer vertical axis, being configured for holding fluid within the outer vessel interior in the first orientation of the fluid timer; and an inner vessel at least partially disposed within and surrounded by the outer vessel interior, the inner vessel having an inner vessel interior extending between a top thereof and a bottom thereof along said timer vertical axis, the inner vessel being formed with one or more ingress ports closer to the bottom than to the top, by means of which the outer and inner vessels are configured to function as communicating vessels to allow filling of the inner vessel with fluid, in the first orientation of the fluid timer, by allowing fluid from the outer vessel to enter the inner vessel through said ingress ports; the inner vessel being further formed with at least one egress port configured to allow the fluid to be emitted therethrough from the inner vessel interior during said pre-determined time when the fluid timer is in the second, reversed orientation, wherein the outer vessel has threading on an inner surface defining the outer vessel interior, the threading corresponding to, and engageable with, that on the bottle throat.

16. The bottle cap according to claim 15, configured to be releasably mounted on the bottle throat so that the outer vessel surrounds the throat with the threadings engaging each other, the outer vessel bottom covering the throat and the inner vessel being disposed within the throat, and so that when the bottle containing fluid is oriented with the throat facing downwardly, the bottle cap mounted on the throat is in the first orientation and fluid from the bottle can be used to fill the inner vessel, whilst when the bottle is brought into a normal orientation thereof with the throat facing upwardly, the fluid timer in the second, reversed orientation, whether left on the bottle's throat or removed therefrom, produces drops emitted through the one or more egress openings of the inner vessel.

17. A bottle having the bottle cap according to claim 15.

* * * * *